US007243817B2

(12) United States Patent
Giraud

(10) Patent No.: US 7,243,817 B2
(45) Date of Patent: Jul. 17, 2007

(54) SOLID OBJECTS DISPENSERS

(75) Inventor: Jean-Pierre Giraud, Paris (FR)

(73) Assignee: CSP Technologies, Inc., Amsterdam, NY (US)

( * ) Notice: Subject to any disclaimer, the term of this patent is extended or adjusted under 35 U.S.C. 154(b) by 549 days.

(21) Appl. No.: 10/683,176

(22) Filed: Oct. 10, 2003

(65) Prior Publication Data

US 2004/0124204 A1 Jul. 1, 2004

Related U.S. Application Data

(60) Provisional application No. 60/417,532, filed on Oct. 10, 2002.

(51) Int. Cl.
*B65G 59/00* (2006.01)
*B65H 3/00* (2006.01)
*G07F 11/16* (2006.01)

(52) U.S. Cl. ..... 221/263; 221/289; 221/265; 221/190; 221/264

(58) Field of Classification Search ..... 221/190, 221/289, 265, 263, 264
See application file for complete search history.

(56) References Cited

U.S. PATENT DOCUMENTS 2,653,706 A * 9/1953 Aggson ..... 221/264
3,383,013 A * 5/1968 Szekely ..... 221/202

(Continued)

FOREIGN PATENT DOCUMENTS

EP 0290972 A1 * 5/1988

(Continued)

*Primary Examiner*—Patrick Mackey
*Assistant Examiner*—Michael E. Butler
(74) *Attorney, Agent, or Firm*—Greenberg Traurig, LLP

(57) ABSTRACT

A tablet dispenser for dispensing individual solid objects comprising a lower housing, an upper housing with an elastomeric cover that covers at least a portion of a trigger mechanism, a elastomeric cover of at least a portion of the lower housing and a dispenser mechanism that is dimensioned to fit within the housings, the dispenser mechanism has a container region and a dispenser zone, the dispenser mechanism has a spring element and a lever mechanism pivotally mounted in the dispensing zone, an interior of the lower housing is provided with a pusher bar which extends from a fore wall of the lower housing back towards an upward extending leg of the lever mechanism, the pusher bar, upward extending leg and a hook element are configured so that the pusher bar is not in contact with the upward extending leg and the extending leg is set back from an opening situated on a fore wall of the lower housing and a hook element of the lever mechanism extends into the dispenser zone blocking tablets from being dispensed through the opening when the dispenser mechanism is at rest but, at the same time, when sufficient force is applied to the elastomeric cover, the dispenser mechanism moves forward, towards the fore wall of the lower housing and the upward extending leg of the lever mechanism contacts the pusher bar, as the upward extending leg pivots in the direction opposite the direction in which the dispenser mechanism is moving, the hook element of the lever mechanism pivots in the opposite direction of the upward extending leg and thus removing the impediment prohibiting the tablet from passing through the opening of the dispensing mechanism.

2 Claims, 11 Drawing Sheets

U.S. PATENT DOCUMENTS

| | | | | | |
|---|---|---|---|---|---|
| 3,896,968 | A * | 7/1975 | Pehr | 221/288 |
| 4,117,956 | A * | 10/1978 | von Schuckmann | 221/288 |
| 4,653,668 | A * | 3/1987 | Gibilisco et al. | 221/298 |
| 4,854,478 | A * | 8/1989 | Gyimothy | 221/190 |
| 5,351,858 | A * | 10/1994 | Bar-Yona et al. | 221/266 |
| 5,372,267 | A * | 12/1994 | Hofmann | 215/220 |
| 6,206,235 | B1 * | 3/2001 | Green | 221/251 |
| 6,726,058 | B2 * | 4/2004 | Giraud | 221/267 |
| 6,824,011 | B1 * | 11/2004 | Woempner | 221/265 |
| 6,948,634 | B2 * | 9/2005 | Evans et al. | 221/202 |
| 2004/0094567 | A1 * | 5/2004 | Pollock et al. | 221/289 |

FOREIGN PATENT DOCUMENTS

| | | | |
|---|---|---|---|
| GB | 2078682 | A * | 1/1982 |
| GB | 2257421 | A * | 1/1993 |

* cited by examiner

SOLID OBJECTS DISPENSERS

CROSS-REFERENCE TO RELATED APPLICATIONS

This application claims the benefit under 35 U.S.C. 119(e) of U.S. Provisional Application Ser. No. 60/417,532, filed Oct. 10, 2002.

FIELD OF THE INVENTION

The present invention is directed to dispensers for solid objects. In one embodiment, the dispenser can be used as a dispenser for pieces of candy. In another embodiment, the dispenser can be used to dispense tablets that, for example, deliver therapeutic substances. In a further embodiment, the dispenser is moisture tight for a desired period (e.g. dispenser's use life, solid objects shelf-stability life).

BACKGROUND OF THE INVENTION

Tablet dispensers are typically employed in the nutritional and candy industries in order to retain and dispense tablets. These dispensers may be designed for specific tablets, such as the Pez dispenser for Pez candy. Because conventional tablet dispensers are not moisture-tight during use life, they are not typically used in industries such as the pharmaceutical industry for moisture sensitive products. Instead, moisture tight tablet packaging has typically been provided by "blister" packs. For "blister packs", the tablet is pushed through a frangible barrier material, in order to separate it from the packaging.

SUMMARY OF THE INVENTION

The present invention is directed to a number of embodiments for tablet dispensers that, in some embodiments, maintain a moisture-tight reservoir of tablets during use life. In one example, the design is suited for pharmaceutical applications, particularly where moisture-sensitivity of the tablet is a consideration.

The present invention is directed to dispensers for dispensing tablets. In one embodiment, the dispenser maintains a moisture tight seal both during shelf life and during use life. In yet another embodiment, the dispenser provides a reservoir for holding a number of tablets, such as, for example, 50 to 100 tablets. In yet another embodiment, the dispenser is provided with a housing that is constructed in part of plastic material of a substantially water impermeable material, such as polypropylene ("PP") or polyethylene ("PE"), while other parts of the housing are constructed of an elastomeric material of a substantially water impermeable material such as an ethylene propylene diene terpolymers (EPDM).

For purposes of the present invention, a dispenser of the present invention is "moisture tight" in accordance with the test protocols set forth in USP 671. In one embodiment, the dispenser is considered "moisture tight" where not more than one of the 10 test dispenser exceeds 100 mg per day, per liter, in moisture permeability. Testing for USP 671 is conducted on sealed containers and on containers that have been opened and then resealed. The testing consists of a desiccant of set quantity 4-8 mesh, anhydrous calcium chloride being first dried at 110 degrees for one hour then cooled in a desiccator. Then 12 containers of uniform size are selected and opened and closed 30 times each. Torque is applied to the closures as specified in the USP monograph.

Desiccant is then added to 10 of the packages labeled test containers. These are then filled to within 13 mm of the opening on containers larger than 20 ml and to two-thirds full-on containers smaller than 20 ml. The closures are then applied to the torque specified in the monograph. Weight is recorded to the nearest 0.1 mg for containers smaller than 20 ml, to the nearest mg for 20 ml to 200 ml, or to the nearest centigram if the container is larger than 200 ml. The containers are stored at 75 percent, plus or minus three percent, relative humidity at a temperature of 23 degrees, plus or minus two degrees. After 36 hours, plus or minus one hour, the weight is recorded, with the moisture permeability calculated in mg per day, per liter.

Elastomeric materials of the present invention should be sufficiently deformable to allow them to be sufficiently deformed when a force is applied to them so that the solid object can pass through the desired exit location. In one embodiment, the elastomeric material is used to construct a lip seal, that is, a specified opening provided in the elastomeric material. The lip seal remains moisture tight when the seal is closed, and is opened only for the time needed to pass a tablet through the opening. In another embodiment, the elastomeric material is used to construct trigger mechanisms that are used to eject the tablets.

In yet another embodiment, the present invention is directed to dispenser mechanisms for dispensing one tablet at a time from the reservoir. In another embodiment, the dispensers are provided with dispensing mechanisms that queue up the tablets prior to dispensing them. In a further embodiment, the present invention is directed to trigger mechanisms employed in dispensing one tablet at a time from the dispenser. In yet another embodiment, the trigger mechanism and location in the dispensers where the tablets queue up are placed within elastomeric materials to insure moisture tightness and further allow the trigger to be operated by applying a force external to the elastomer.

In yet another embodiment the dispenser is sized so that the housing interiors are sized only as thick as one tablet. In another embodiment, the dispenser maintains a moisture-tight seal within the tablet reservoir throughout the dispenser use life. In another embodiment, a desiccant, such as a desiccant entrained plastic, is used in at least a portion.

DETAILED DESCRIPTION OF THE INVENTION

Figure 1:
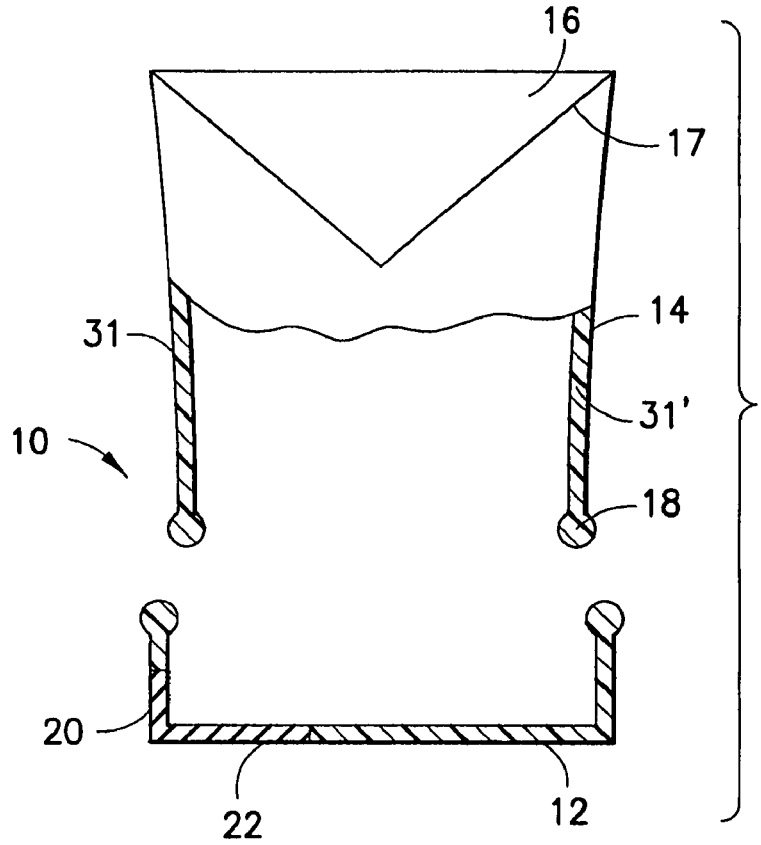
FIG. 1 is a perspective view of a first embodiment of a dispenser of the invention.
Figure 2:
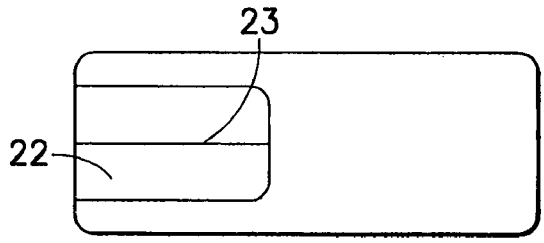
FIG. 2 is side elevational view of another side of the dispenser shown in FIG. 1.

FIG. 1 illustrates a first embodiment of a dispenser produced in accordance with the invention. Generally, dispenser 10 is provided with a lower housing 12, upper housing 14, an elastomeric cover 16, a seal 18 that joins the lower and upper housings, and a cover 20 of an elastomer that covers the portions of the lower housing. A lip seal 22 (best viewed in FIG. 2), through which a tablet is dispensed, is provided in the elastomer.

For purposes of the present invention, a "lip seal" is formed by two lip sides that converge at the thin, slit like opening. In one example, the "lip seal" is formed by molding the two lip sides that converge at a thin slit-like opening. In another example, the "lip seal" is formed by molding a membrane and then cutting a slit in the membrane. The lip seal is designed so that it is opened for a sufficient time needed to pass an item through it as a sufficient ejecting force is applied to the item.

In one embodiment, the housing components of the dispenser may be provided with long sides that have a slight curvature and endwalls 31, 31' joined to the sidewalls by corners, which are squared or rounded. The housing components are hollow in their interior and house the boat 50 (described below) in which tablets are stored. In another embodiment, the interior width dimension of the housing components may be only slightly greater than the boat, which in turn has a width only slightly greater than a single tablet that would be housed in the dispenser. This arrangement provides for storage of the tablets in a single-thickness arrangement.

The housing components are formed of an injection molded plastic (e.g. clarified polypropylene or polyethylene). In one embodiment, the outer surface of the upper housing may be made of a sufficiently water impermeable plastic (e.g. PP or PE) and at least a portion of the inner surface may be overmolded with a desiccant entrained plastic, such as the desiccant entrained plastic formulations disclosed in U.S. Pat. Nos. 5,911,937, 6,214,255, 6,130,263, 6,080,350 and 6,174,952, 6,124,006, and 6,221,446, all of which are incorporated herein by reference.

Upper housing 14 is provided, at its outer end, with a v-shaped cut 17, in which the relatively hard plastic material that constructs the housing is replaced with a relatively softer elastomeric cover 16. Due to its relative softness, elastomeric cover 16 will deform when a sufficient force is applied to the cover.

Figure 3:
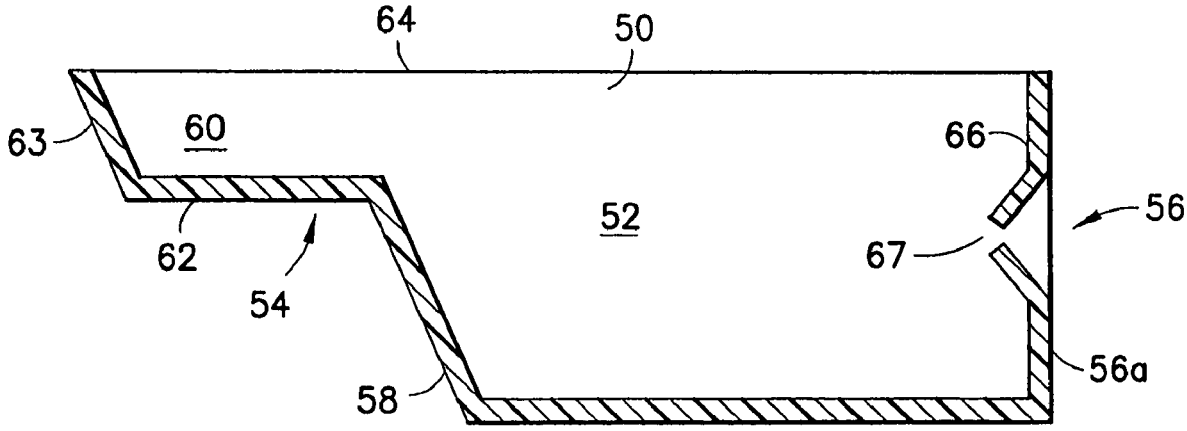
FIG. 3 is a cross sectional view of the boat used in the dispenser shown in FIG. 1.
Figure 4:
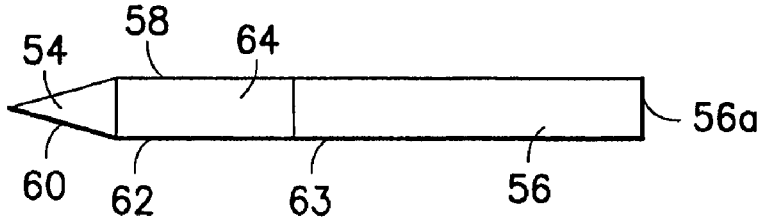
FIG. 4 is a top plan view of the boat shown in FIG. 3.

FIGS. 3 and 4 illustrate one embodiment of boat 50, which is sized to fit within the housing. The boat 50 is provided with a reservoir portion 52 that is slightly less wide than the interior of the housing. The reservoir portion retains a plurality of tablets, which are arrayed in a side-by-side, one-tablet thick arrangement. The appropriate dimension of the reservoir portion insures that the tablets are retained in a one-tablet thick arrangement. The boat has a bow section 54, and an aft section 56. A back wall 56*a* is located in the aft section of the boat.

The bow section 54 has a first tapered sidewall 58 and a ship's bow 60. The ship's bow is dimensioned to retain only one tablet. The ship's bow is defined by a first sidewall 62, which extends away from the reservoir, and a second sidewall 63 that extends away from the first sidewall. In FIG. 3, the second sidewall is shown as extending away from the first sidewall at an oblique angle.

In one specific embodiment, the boat 50 is open along side 64, or open for at least a portion of the ship's bow, in order to permit a tablet to pass out of the bow.

In one example, the dispenser is assembled as follows. Tablets are loaded into the reservoir of the boat. The boat is loaded into the housing by placing the aft region of the boat into the upper housing. The lower housing is joined and sealed to the upper housing. With this arrangement, the ship's bow is positioned within the housing, adjacent to the lip seal 22 of the elastomeric cover 20.

To dispense a tablet, the user applies a force to the elastomeric cover 16 in the cut-out region 17 of the upper housing 14, in an amount sufficient to deform the relatively soft elastomeric material. The force is transferred to the aft side 66 of the boat, which moves the boat 50 towards the lower housing. The ship's bow 60 passes through the slit 23 of the lip seal 22, and the tablet is dispensed from the ship's bow.

Figure 5A:
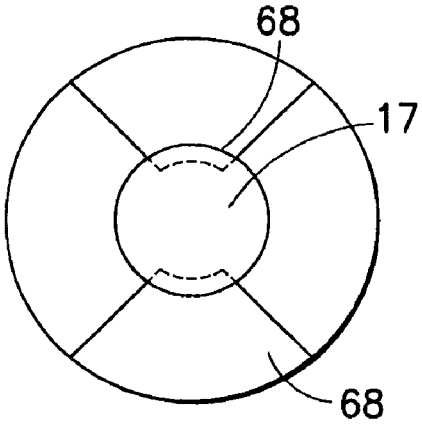
FIG. 5A is a side elevational view of the button shown in FIG. 5.
Figure 5:
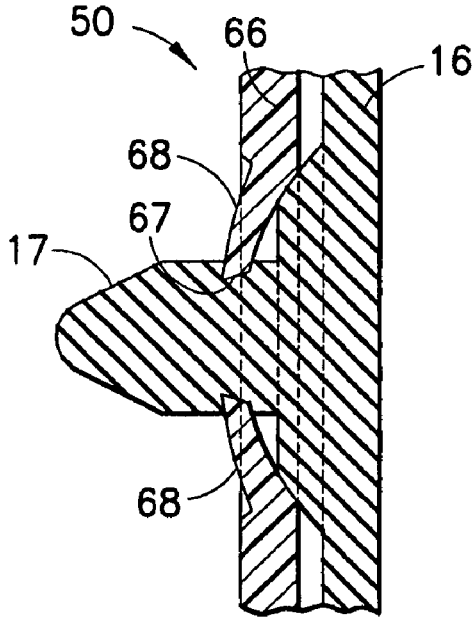
FIG. 5 is a perspective view of a feature that may be employed in the present invention.

In another embodiment, shown in FIGS. 5 and 5A, the elastomeric cover 16 is provided with a button 17 that extends into opening 67 in the aft side 66 of the boat 50. The button 17 and the opening 67 form an interference fit with prongs 68 extending from the wall in the aft side 66, so that when the force is removed from the elastomeric cover, the cover returns to it original shape, and pulls the boat back to its original position within the housing.

Figure 6:
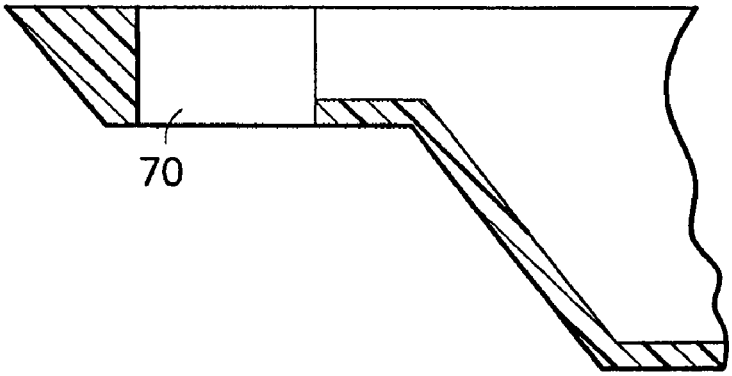
FIG. 6 is a cross sectional view of another embodiment of a boat that may be used in the dispenser shown in FIG. 1.

In yet another embodiment, the ship's bow is provided with a slot 70 on its under side, as shown in FIG. 6. In this arrangement, the tablet falls through the slot when the ship's bow passes out of the slot.

Figure 7:
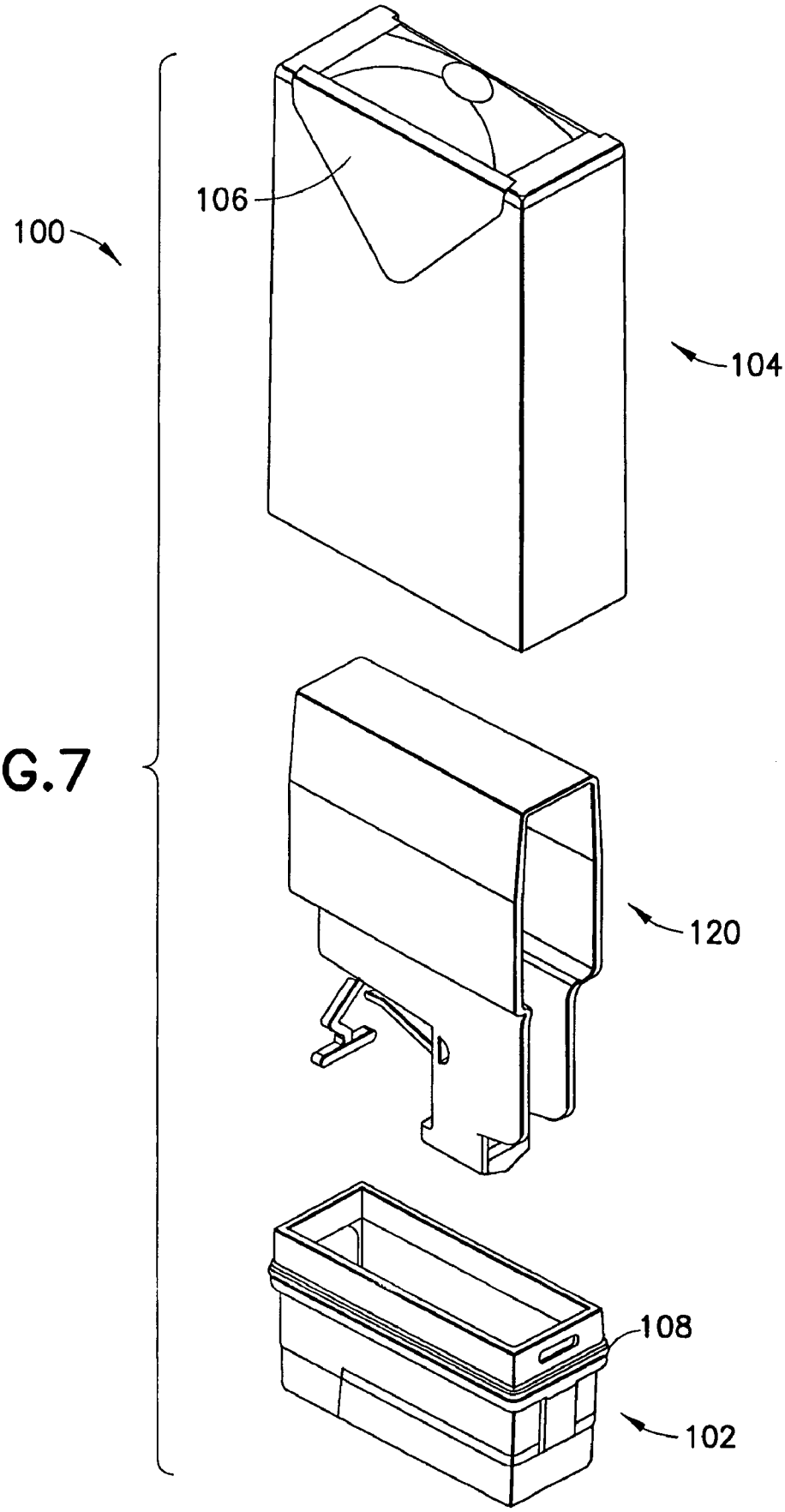
FIG. 7 is an exploded view showing another embodiment of the present invention.
Figure 8:
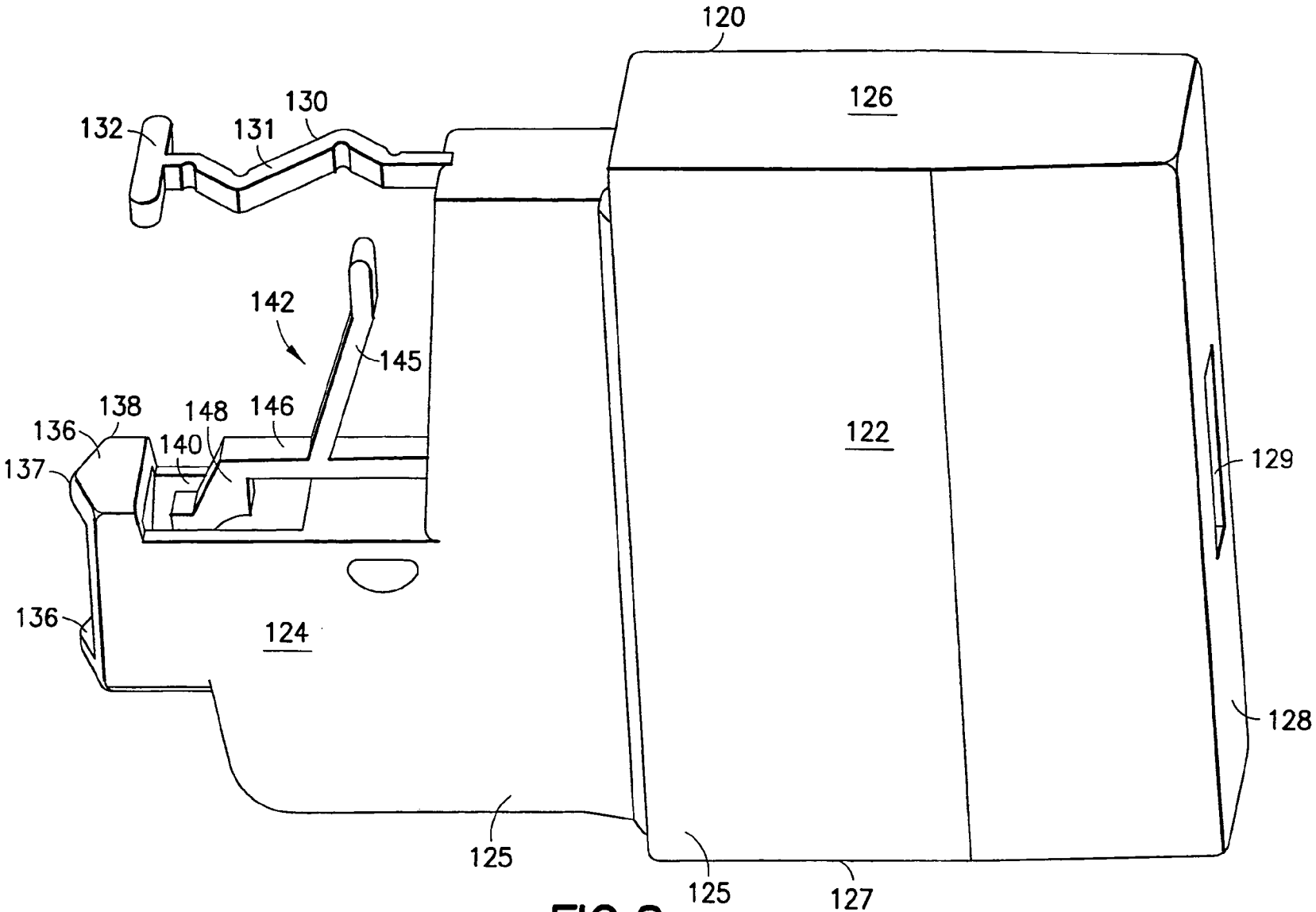
FIG. 8 is a perspective view showing an aspect of the FIG. 7 embodiment.
Figure 9:
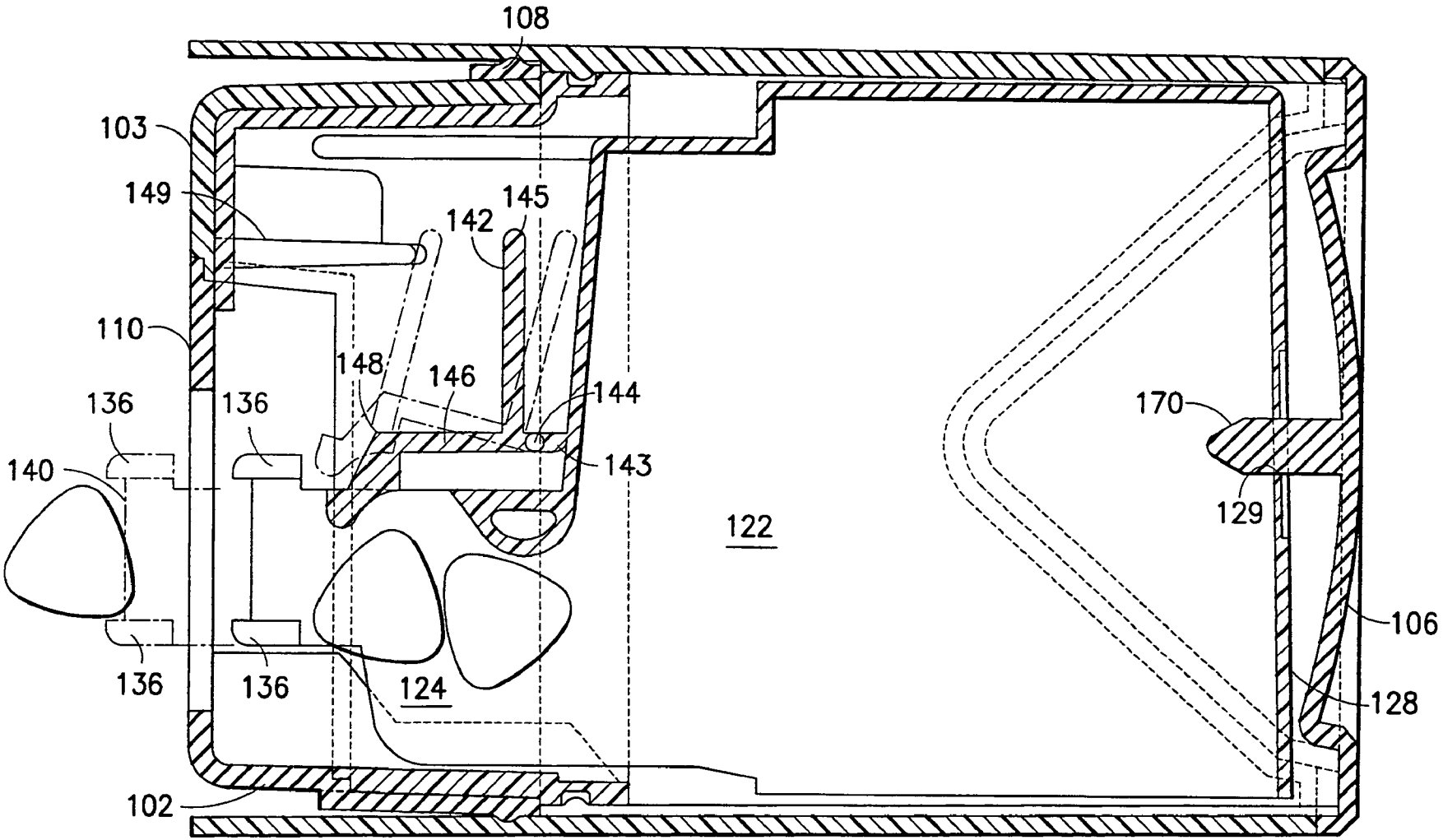
FIG. 9 is a cross sectional view of the FIG. 7 embodiment, assembled and depicting the dispenser at rest and activated to dispense a tablet.
Figure 10A:
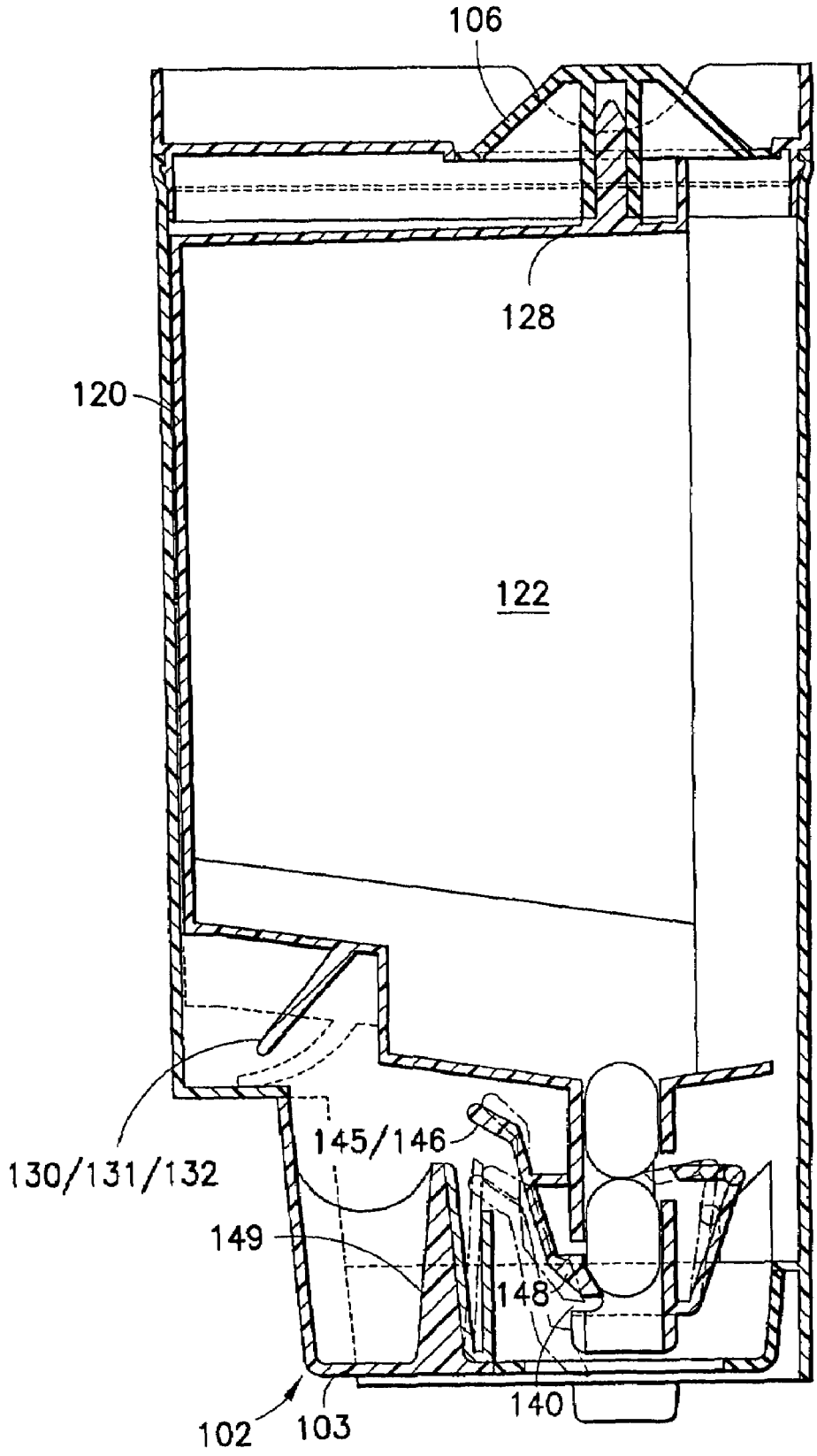
FIGS. 10A-10C are cross sectional views of yet another embodiment, depicting the dispenser at rest and activated to dispense a tablet.
Figure 10B:
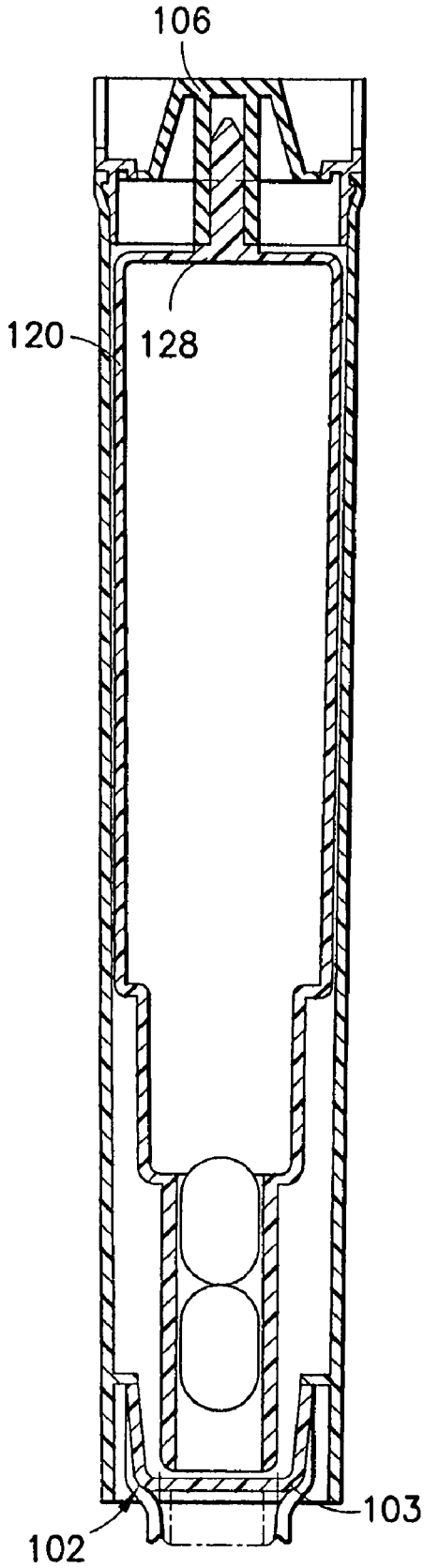
Figure 10C:
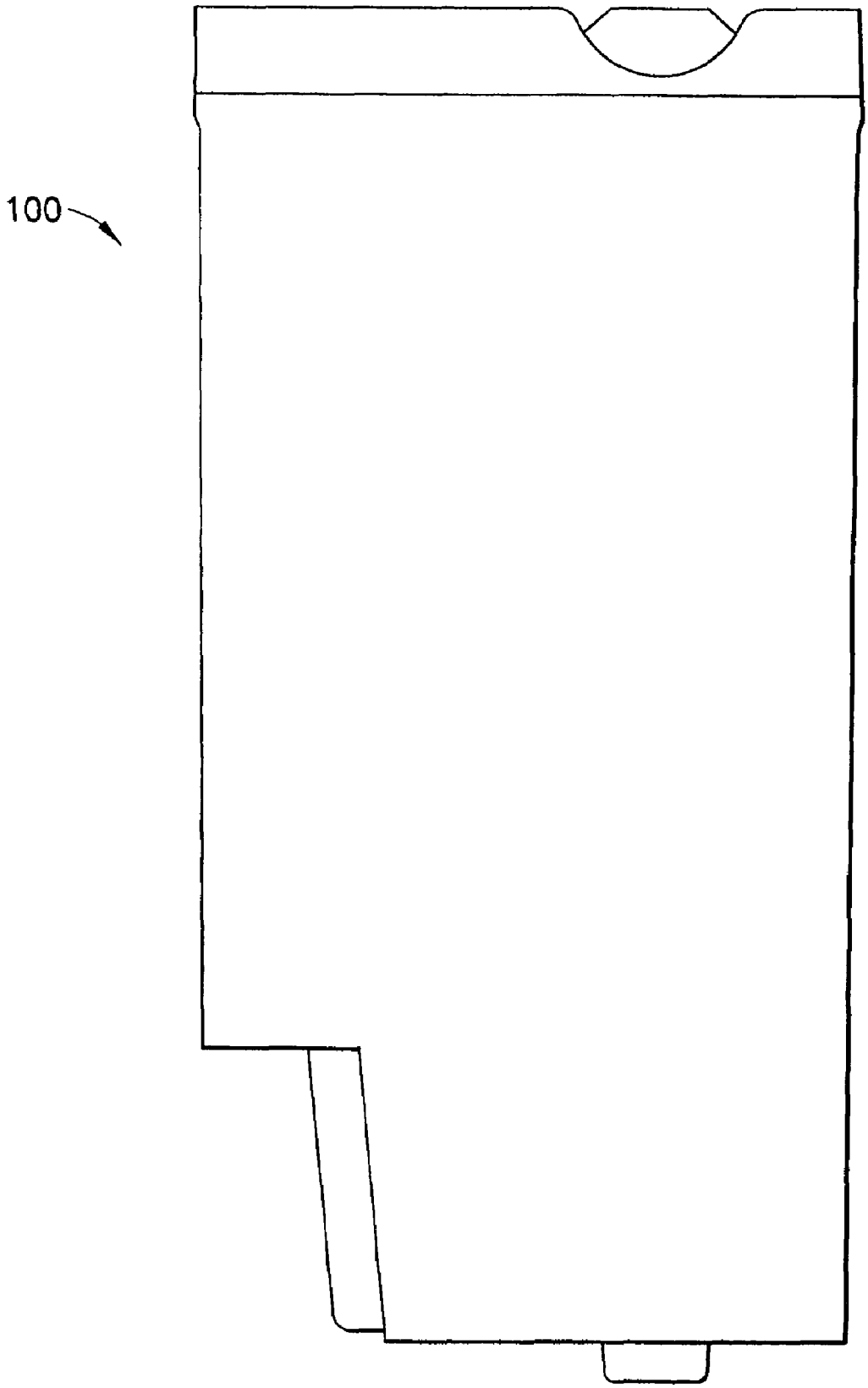
Figure 11:
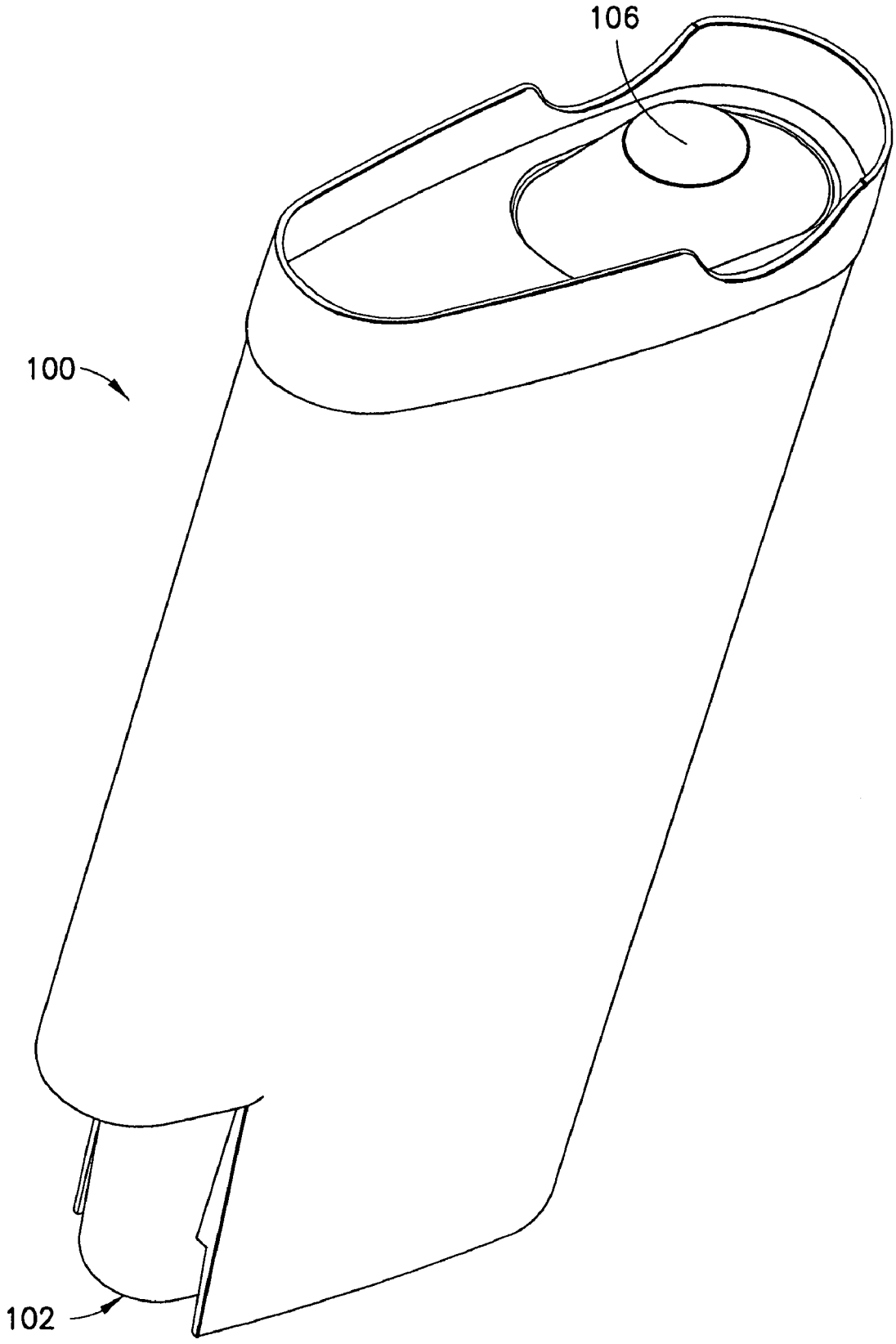
FIGS. 11-13 are perspective views showing aspects of FIGS. 10A-C embodiment.
Figure 12:
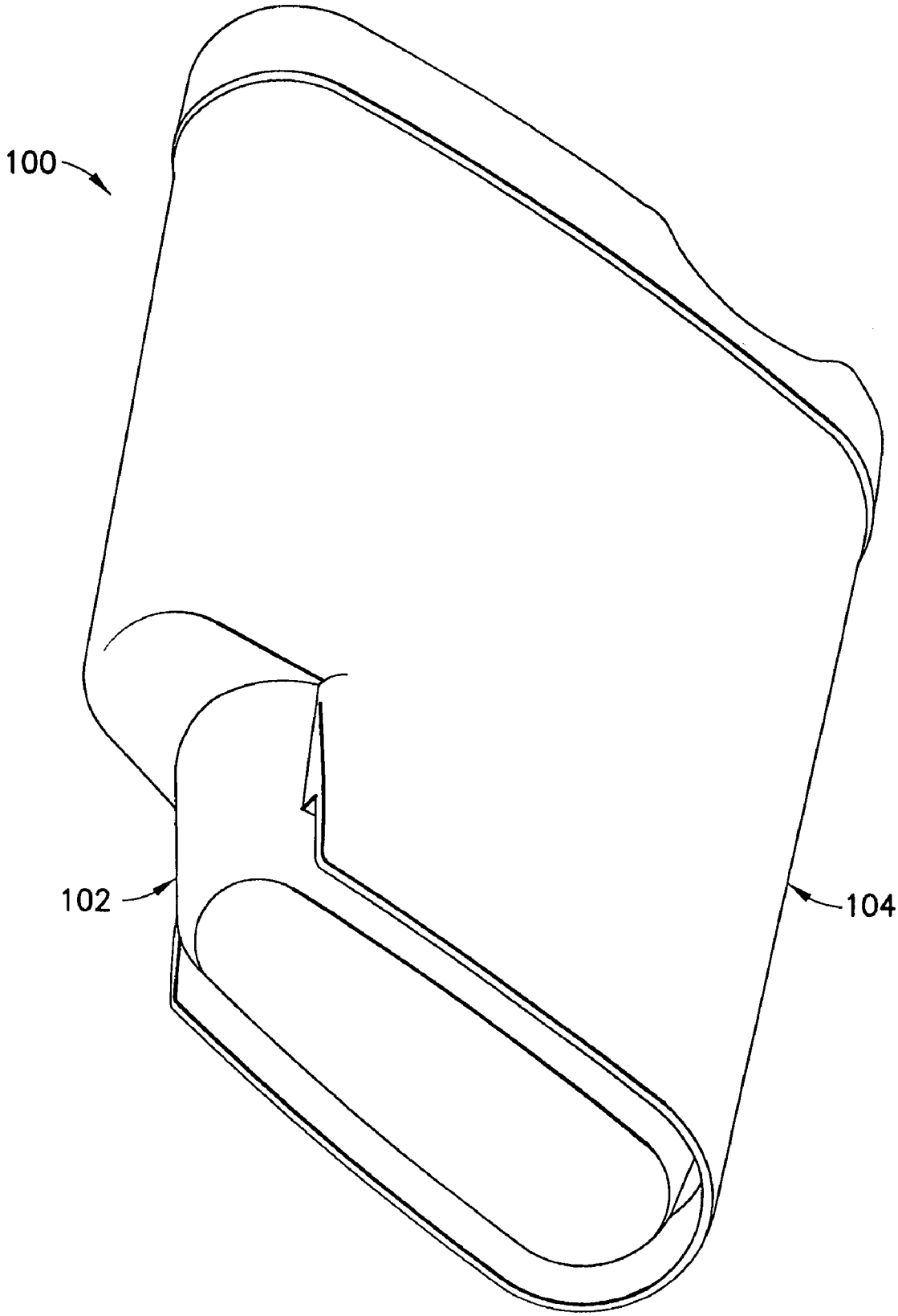
Figure 13:
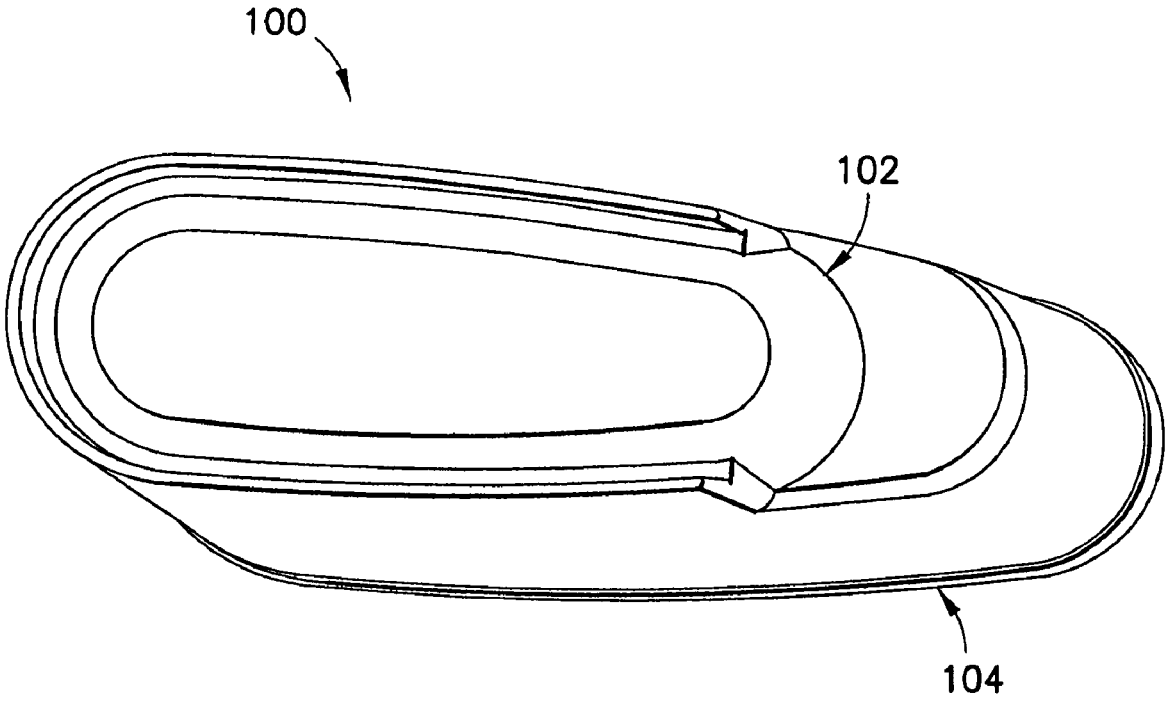

FIGS. 7 to 9 show yet another embodiment of a dispenser 100 of the present invention. FIG. 7 is an exploded view showing the components of the present invention. Generally, dispenser 100 is provided with a lower housing 102, upper housing 104, an elastomeric cover 106 that covers the trigger mechanism, a seal 108 that joins the lower and upper housings, and, as best seen in FIG. 9, a cover 110 of an elastomer that covers the portions of the lower housing. Seal 108 may be formed of LDPE or other suitable material. The seal 108 can be any type of seal that results in a substantially moisture tight sealing arrangements for container and cap assemblies. Alternatively, an elastomeric material can be overmolded over the region to be sealed in accordance with the principles discussed elsewhere in this disclosure.

It is understood that the lower housing 102, upper housing 104, elastomeric cover 106 that covers the trigger mechanism, seal 108 that joins the lower and upper housings, and cover 110 of an elastomer that covers the portions of the lower housing can be individually assembled or one or more of these parts can be molded/secured together and then assembled with the other parts (e.g. the lower and upper housing are molded as one part).

In another embodiment, a lip seal 22', with slit 23', through which a tablet is dispensed, is provided in the elastomer. The lip seal may have the same configuration as in FIG. 2. The elastomeric cover 106 and lip seal 22' may be constructed of an elastomeric material, such as EPDM, (e.g. commercially available under the trade name Santoprene). The lower housing 102 may be over-molded either in a two-shot injection molding machine or made in two injection molding processes (that is, injection mold the plastic in mold 1, then over-mold the elastomeric material in mold 2). In the embodiment shown in the Figures, the elastomeric material covers the sidewalls and end where the ejector is activated (i.e., elastomeric cover 106), and at the opposite end where the slit 22 is located. The elastomeric material (or suitable comparable material) is sufficiently deformable so that the user can impart a sufficient force to the ejector so as to activate it and thus, the tablet can then moved through the slit and ejected.

When the housing is assembled, the seal is overmolded to form a substantially moisture tight seal, prohibiting the ingress of moisture into the housing.

In yet another embodiment, the dispenser apparatus also includes dispenser mechanism 120 that is dimensioned to fit within the housing 100, and move side-to-side, during the dispensing of a tablet, and return to the rest position. As a practical matter, the dispenser mechanism 120 will be loaded into housing full of tablets, the housing will be assembled, and then the housing will be sealed as described above.

FIG. 8 shows another view of the dispenser mechanism 120 and its structural attributes. Dispenser mechanism 120 may be constructed of plastic materials, and molded in accordance with conventional molding techniques. The dispenser mechanism 120 has a container region 122 and a dispenser zone 124, generally defined by sidewalls 125, top wall 126, bottom wall 127, and aft wall 128. The aft wall is provided with an opening 129. Button 170 is provided on the interior side of the elastomeric cover 106 and is inserted in the opening 129 to form an interference fit, so that when the force is removed from the elastomeric cover, the cover returns to it original shape, and pulls the boat back to its original position within the housing. This arrangement can be constructed as shown in FIGS. 5 and 5A.

In one specific embodiment, the front end of the dispenser mechanism 120 has a relatively flexible spring element 130. As shown, the spring element has extension 131 with a switchback configuration, alternatively extending to the right and left, terminating in crossbar 132. While the switchback configuration of the extension 131 imparts a desirable degree of flexibility that permits the spring element to compress and store energy, and the cross bar 132 distributes the load borne under compression across a relatively large surface area, it should be readily apparent that other designs are suitable for this application.

In yet another embodiment, dispenser mechanism 120 is further provided with a forwardly extending dispenser zone 124. Bumpers 136 are at the fore of the dispenser zone 124. As best seen in FIG. 8, the bumpers have a relatively narrow apex 137 at their fore, and broaden to a relatively wider base 138. An opening 140, for dispensing a tablet, is situated in the space between the bumpers. The opening is sized so that a tablet can pass through the opening without encountering substantial interference from nearby structure.

In one example, lever mechanism 142 is pivotally mounted at the upper portion 143 of the dispensing zone 124, at pivot element 144 that joins the lever mechanism 142 to the upper portion 143. Lever mechanism 142 has an upward extending leg 145, which extends upward from about the point where the lever mechanism 142 is pivotally mounted to the upper portion 143. The upward extending leg 145 is joined to horizontal member 146 of the lever mechanism 142. Downwardly depending hook element 148 extends downward from the horizontal member 146 of the lever mechanism 142. The hook element 148 extends down into the space where tablets are situated near the opening 140, and when in that position, will block tablets from being dispensed.

FIG. 9 shows the dispenser mechanism 120 installed within the housing 100, with representative tablets depicted in the dispensing zone 124. The interior of the lower housing 102 is provided with a pusher bar 149 which extends from fore wall 103 of the lower housing 102 back towards the upward extending leg 145 of the lever mechanism 142. When the dispenser mechanism 120 is at rest, the pusher bar 149 is not in contact with the upward extending leg 145, and the bumpers 136 are set back from the lip seal 22' situated on the fore wall 103 of the lower housing 102. Also, while at rest, the hook element 148 extends into the distribution zone, blocking tablets from being dispensed through the opening 140.

For example, when a person applies a force to the elastomeric cover 106 situated at the aft of the housing, he or she sets in motion the following events that lead to the dispensing of a tablet. When sufficient force is translated from the cover 106 to the aft wall 128 of the dispenser mechanism 120, the dispenser mechanism moves forward, towards the fore wall 103 of the lower housing 102. After moving for a distance, the upward extending leg 145 of the lever mechanism 142 contacts the pusher bar 149 that extends inward from the fore wall 103 of the lower housing 102. As the lever mechanism is pivotally mounted, the upward extending leg 145 pivots in the direction opposite the direction in which the dispenser mechanism is moving, when sufficient force is translated from pusher bar 149 the to the upward extending leg 145. In turn, this lifts the hook element 148, removing the impediment prohibiting the tablet from passing through the opening of the dispensing mechanism.

The dispensing mechanism continues to move forward; with the bumpers 136 contacting the interior side of the lip seal 22'. The bumpers open the slit 23' in the lip seal 22', pass therethough, and the tablet is dispensed through the opening. At the time the tablet is dispensed, the crossbar 132 of the spring element 130 is in contact with the fore wall 103 of the lower housing 102. The spring element is in compression. When the person has dispensed a tablet and releases the applied force to the cover 106 at the back end of the housing, the spring element 130 releases the energy it has stored, and pushes the dispenser mechanism back to the rest position. Also, when the force is released from the elastomeric cover 106, it returns to its original position. Button 170 provided on the interior side of the elastomeric cover 106 thereby exerts a return force on the dispensing mechanism by virtue of the interference fit between button 170 and the opening 129 in the rear wall of the dispensing mechanism.

FIGS. 10A-C, and 11-13 are another example and show the dispenser mechanism installed within the housing, with representative tablets depicted in the dispensing zone. The interior of the lower housing is provided with a pusher bar 149 which extends from fore wall 103 of the lower housing 102 back towards the upward extending leg 145/146 of the lever mechanism. When the dispenser mechanism is at rest, the pusher bar 149 is not in contact with the upward extending leg 145/146, and the extending leg is set back from the lip seal 22' situated on the fore wall 103 of the lower housing 102. Also, while at rest, the hook element 148 of the lever mechanism extends into the distribution zone, blocking tablets from being dispensed through the opening 140.

For example, when a person applies a force to the elastomeric cover 106 situated at the aft of the housing, he or she sets in motion the following events that lead to the dispensing of a tablet. When sufficient force is translated from the cover 106 to the aft wall 128 of the dispenser mechanism 120, the dispenser mechanism moves forward, towards the fore wall 103 of the lower housing 102. After moving for a distance, the upward extending leg 145/147 of the lever mechanism contacts the pusher bar 149 that extends inward from the fore wall 103 of the lower housing 102. As the lever mechanism is pivotally mounted, the upward extending leg 145/146 pivots in the direction opposite the direction in which the dispenser mechanism is moving, when sufficient force is translated from pusher bar 149 the to the upward extending leg 145/146. In turn, this pivots the hook element 148 of the lever mechanism in the opposite direction of the upward extending leg 145/146, removing the impediment prohibiting the tablet from passing through the opening of the dispensing mechanism.

The dispensing mechanism continues to move forward. In one specific embodiment, the upward extending leg 145/146 opens the slit 23' in the lip seal 22', pass therethough, and the tablet is dispensed through the opening. At the time the tablet is dispensed, the crossbar 132 of the spring element 130 is in contact with the fore wall 103 of the lower housing 102. The spring element is in compression. When the person has dispensed a tablet and releases the applied force to the cover 106 at the back end of the housing, the spring element 130 releases the energy it has stored, and pushes the dispenser mechanism back to the rest position. Also, when the force is released from the elastomeric cover 106, it returns to its original position. Button 170 provided on the interior side of the elastomeric cover 106 thereby exerts a return force on the dispensing mechanism by virtue of the interference fit between button 170 and the opening 129 in the rear wall of the dispensing mechanism.

In one specific embodiment, the dispenser including the lip seal forms a substantially moisture tight container. Finally, the invention is not limited to the embodiments shown in the drawings.

What is claimed is:

1. A tablet dispenser for dispensing individual solid objects, comprising: a lower housing, an upper housing with an upper elastomeric cover that covers at least a portion of a trigger mechanism, a lower elastomeric cover of at least a portion of the lower housing and a dispenser mechanism that is dimensioned to fit within the housings, the dispenser mechanism has a container region and a dispenser zone, the dispenser mechanism has a spring element and a lever mechanism pivotally mounted in the dispensing zone, an interior of the lower housing is provided with a pusher bar which extends from a fore wall of the lower housing back towards an upward extending leg of the lever mechanism, the pusher bar, the upward extending leg and a hook element of the lever mechanism are configured so that the pusher bar is not in contact with the upward extending leg and the upward extending leg is set back from an opening situated on the fore wall of the lower housing and the hook element of the lever mechanism extends into the dispenser zone blocking tablets from being dispensed through the opening when the dispenser mechanism is at rest but, when sufficient force is applied to the upper elastomeric cover, the dispenser mechanism moves forward, towards the fore wall of the lower housing and the upward extending leg of the lever mechanism contacts the pusher bar, as the upward extending leg pivots in the direction opposite the direction in which the dispenser mechanism is moving, the hook element of the lever mechanism also pivots to remove the impediment prohibiting the tablet from passing through the opening of the dispensing mechanism;

wherein the lower elastomeric cover comprises a lip seal, wherein the lip seal is formed by two flexible lip sides that converge at a thin slit, wherein the lip seal allows a tablet to pass therethough, and wherein the lip seal forms a substantially moisture tight container.

2. The tablet dispenser of claim 1, wherein the upper elastomeric cover is provided with a button that extends into an opening of the upper housing, the button and the opening form an interference fit with prongs so that, when the force is removed from the upper elastomeric cover, the upper elastonieric cover returns to it original shape, and pulls the dispenser mechanism back to its original position within the housing.

* * * * *